US011760082B2

(12) United States Patent
Partosch et al.

(10) Patent No.: US 11,760,082 B2
(45) Date of Patent: Sep. 19, 2023

(54) METHOD FOR CHECKING THE QUALITY OF PRINTED MATERIALS

(71) Applicant: KOENIG & BAUER AG, Würzburg (DE)

(72) Inventors: Alexander Partosch, Bad Salzuflen (DE); Christian Schnieder, Rheda-Wiedenbrück (DE); Johannes Schweers, Verl (DE); Harald Willeke, Paderborn (DE)

(73) Assignee: KOENIG & BAUER AG, Würzburg (DE)

( * ) Notice: Subject to any disclaimer, the term of this patent is extended or adjusted under 35 U.S.C. 154(b) by 0 days.

(21) Appl. No.: 17/928,650

(22) PCT Filed: Jun. 25, 2021

(86) PCT No.: PCT/EP2021/067489
§ 371 (c)(1),
(2) Date: Nov. 30, 2022

(87) PCT Pub. No.: WO2022/053195
PCT Pub. Date: Mar. 17, 2022

(65) Prior Publication Data

US 2023/0191775 A1 Jun. 22, 2023

(30) Foreign Application Priority Data

Sep. 9, 2020 (DE) ..... 10 2020 123 472.4

(51) Int. Cl.
*B41F 33/00* (2006.01)
*B41N 3/00* (2006.01)

(52) U.S. Cl.
CPC ..... *B41F 33/0036* (2013.01); *B41N 3/003* (2013.01)

(58) Field of Classification Search
CPC ..... B41F 33/0036; B41N 3/003
See application file for complete search history.

(56) References Cited

U.S. PATENT DOCUMENTS 10,556,420 B2 2/2020 Perrier
2008/0017619 A1* 1/2008 Yamakawa ..... G06K 1/121 219/121.81

(Continued)

FOREIGN PATENT DOCUMENTS

DE 102004019978 B3 8/2005
DE 102004038542 A1 2/2006

(Continued)

OTHER PUBLICATIONS

International Search Report PCT/EP2021/067489 dated Sep. 9, 2021.

*Primary Examiner* — David H Banh
(74) *Attorney, Agent, or Firm* — MATTINGLY & MALUR, PC

(57) ABSTRACT

Some examples include checking the quality of printed products that are consecutively produced by multiple printing presses to have at least three printed patterns spaced apart from one another. The printed patterns are printed using different printing processes, such as a steel engraving process, an offset printing process, and a screen printing process that may be used for printing the three printed patterns of each printed product. A screen printing press is used for the screen printing process, with multiple steel plates being alternately used in the same production operation for the steel engraving process in an intaglio printing press. For at least two of the steel plates involved in carrying out the steel engraving process, a processing unit may selectively ascertain the deviation of the respective value of the relevant distances associated with the printed patterns, (Continued)

which may be instantaneously ascertained from a defined scale.

11 Claims, 1 Drawing Sheet

(56) References Cited

U.S. PATENT DOCUMENTS

| | | | | |
|---|---|---|---|---|
| 2009/0226232 | A1* | 9/2009 | Scholzig | B41F 19/007 399/15 |
| 2013/0044347 | A1* | 2/2013 | Kitai | H04N 1/4092 358/1.14 |

FOREIGN PATENT DOCUMENTS

| | | | |
|---|---|---|---|
| DE | 102016213111 | A1 | 1/2018 |
| EP | 3539777 | A1 | 9/2019 |

* cited by examiner

METHOD FOR CHECKING THE QUALITY OF PRINTED MATERIALS

CROSS-REFERENCES TO RELATED APPLICATIONS

This application is the US national phase, under 35 USC § 371, of PCT/EP2021/067489, filed on Jun. 25, 2021, published as WO 2022/053195 A1 on Mar. 17, 2022, and claiming priority to DE 10 2020 123 472.4, filed Sep. 9, 2020, the disclosures of which are expressly incorporated by reference herein in their entireties.

TECHNICAL FIELD

Examples herein relate to a method for checking the quality of printed materials that are consecutively produced in a particular production operation by means of multiple printing presses. For example, at least three printed patterns may be arranged on a respective area to be printed of each of these printed materials so as to be spaced apart from one another at a distance defined for this printed material. The printed patterns may each be printed in printing methods that differ from one another. For checking the quality of the respective printed material, two printed patterns printed in differing printing methods may be selected by an inspection system for forming a printed pattern pair. The printed pattern pair may be assigned a scale that is defined for the distance of its printed patterns. Prior to the start of the particular production operation, this scale may be provided with a tolerance that is defined as a function of the printing methods used in the relevant printed pattern pair. At least in a subset taken from the quantity of all printed materials that have been consecutively produced in the particular production operation, the quality of the produced printed materials may be checked in that, during the particular printing operation, an instantaneous value for the respective distance between the printed patterns selected for this printed pattern pair may be ascertained by means of a processing unit of the inspection system, with the printed pattern pair being the same. The processing unit compares the respective value of the relevant distances, which may be instantaneously ascertained, to the scale defined for this distance, while taking into consideration the associated tolerance, and may ascertain a deviation of the respective value of the relevant distances from its defined scale, while taking into consideration the associated tolerance. In some cases, a steel engraving method and an offset printing method may be used as printing methods for printing the printed patterns involved in the production of each printed material. For instance, an intaglio printing press may be used for carrying out the steel engraving method, and an offset printing press may be used for carrying out the offset printing method.

BACKGROUND

A method for checking the quality of printed materials can be derived from U.S. Pat. No. 10,556,420 B2, wherein the printed materials are consecutively produced in a particular production operation by means of multiple printing presses; in each case at least three printed patterns being arranged on a respective area to be printed of each of these printed materials so as to be spaced apart from one another at a distance defined for this printed material; these at least three printed patterns being each printed in printing methods that differ from one another; for checking the quality of the respective printed material, two printed patterns printed in differing printing methods being selected by an inspection system for forming a printed pattern pair; the printed pattern pair being assigned a scale that is defined for the distance of its printed patterns; prior to the start of the particular production operation, this scale being provided with a tolerance that is defined as a function of the printing methods used in the relevant printed pattern pair; at least in a subset taken from the quantity of all printed materials that have been consecutively produced in the particular production operation, the quality of the produced printed materials being checked in that, during the particular printing operation, in each case an instantaneous value for the respective distance between the printed patterns selected for this printed pattern pair being ascertained by means of a processing unit of the inspection system, with the printed pattern pair being the same in each case; the processing unit comparing the respective value of the relevant distances, which is instantaneously ascertained in each case, to the scale defined for this distance, taking into consideration the associated tolerance, and ascertaining a deviation of the respective value of the relevant distances, which is instantaneously ascertained in each case, from its defined scale, taking into consideration the associated tolerance; a steel engraving method and an offset printing method being used as printing methods for printing the printed patterns involved in the production of each printed material; and an intaglio printing press being used for carrying out the steel engraving process and an offset printing press being used for carrying out the offset printing process.

A method for evaluating the quality of printed matter produced by a printing press is known from DE 10 2004 019 978 B3, wherein, within a selected quantity of copies, an error of a particular error type or a particular characteristic detected on a copy is evaluated in relation to at least one error detected on the same or a different copy, taking into consideration a relation between at least one of the detected error types and one of the characteristics of the detected error.

EP 3 539 777 A1 discloses a method for enhancing the print quality based on a correction of a printing position of printing units in a printing press, based on the ascertainment of actual and target position values and a difference value characterizing the deviation.

It is known from DE 10 2004 038 542 A1 that the print pattern of a security element can, for example, be implemented by way of screen printing, offset printing, indirect letterpress printing, letterpress printing, digital printing, inked or blind-debossed recess printing, it also being possible to use combinations of printing methods.

It is also known from DE 10 2016 213 111 A1 that a number of different printing methods are used in the production of banknotes or other value documents. For example, a steel engraving method and/or an offset printing method and/or a screen printing method and/or a plateless printing method, i.e., a digital printing method, for example an inkjet printing method and/or a laser printing method may be used in the production of banknotes.

The present invention primarily relates to the technical field of the industrial production of printed materials to be configured in each case as a security document, in particular as a banknote. In general, several different printing methods are involved in the production of such printed materials, which are carried out either in a contiguous production system or successively in consecutive production steps, by means of respective separate printing presses that are arranged spatially separated from one another. These printed materials usually include a number of different printed patterns, of which a first printed pattern, for example, is printed in a steel engraving method, and a second printed pattern is printed in an offset printing method, and a third printed pattern is printed in a screen printing method. Each of these printed patterns is generally a complex structure that is in each case made up of a multiplicity of print elements and formed on an area to be printed of the relevant printed material. The printed materials of the type in question to be produced are generally formed on a printing substrate that is to be guided through the relevant production system or the involved printing presses. In the invention present here, the printing substrate used is preferably a printing substrate that is each case configured as a sheet, wherein this printing substrate is, in particular, a printing substrate suitable for the production of banknotes and, for example, is made of paper, in particular a specialty paper for security documents, or is made of a polymer material.

Such printed materials usually include several different security features, such as a foil application and/or a windowed thread and/or a security thread located inside the printing substrate and/or a watermark. These security features are either already introduced into the printing substrate or applied thereto in the paper mill creating the printing substrate or in the printing company printing the printing substrate, in machines other than the printing presses that print the printed patterns.

The geometric arrangement of the printing images, which are each printed spaced apart in a particular printed material using in different printing methods on the area to be printed of this material, in their respective relationship with respect to one another and/or the geometric arrangement of one of these printed patterns in relation to at least one security feature that is provided in or on the area to be printed of this material and/or the geometric arrangement of one of these printed patterns in relation to an edge delimiting the area to be printed of this material, are referred to hereafter as print register.

Before the start of a particular production operation, the respective print register is established for the printed patterns involved in the production of the relevant printed material in that in each case a distance scale, including an associated tolerance, is defined for the respective geometric arrangement of these printed patterns intended on the area to be printed of this printed material. At least subsequent to the completed production, preferably, however, even during ongoing production for the creation of the relevant printed material, adherence to the previously defined print register must be checked to obtain information as to the quality of the relevant produced printed material.

It is therefore necessary to check the quality of the relevant produced printed material since a variety of different causes affecting production can adversely affect the desired quality and, especially in their interaction, can cause wasted paper to be produced, even though the printing quality of the printed patterns involved in the printed material per se may be free of defects in each case. The present invention is therefore not about evaluating, for example, a color register of an individual particular printed pattern, wherein the evaluation of the color register in an individual particular printed pattern would relate to the relationship of its print elements among one another, but about a method for checking the quality of printed materials produced consecutively in a particular production operation, wherein in each case at least three printed patterns, which are each printed using printing methods that differ from one another, are arranged in each of these printed materials on the respective area to be printed so as to be spaced apart from one another in each case at a distance that is defined for this printed material, wherein the print register of these printed patterns, which is determined by the geometric arrangement of these printed patterns defined by the respective defined distance, is preferably checked inline, that is, during an ongoing printing process. If this check leads to a result that indicates that the desired quality of the relevant printed material to be produced is not ensured in the ongoing printing process, it is possible, for example, for a control unit or a processing unit to take counter measures, preferably automatically, by changing at least one setting of the relevant printing press.

The quality of the printed materials of the type in question to be produced can, for example, be impaired by one of the employed printing methods. For example, a steel engraving method, which can be a recess printing method or an intaglio printing method, deforms the sheet in a very clearly discernible manner. This may, in particular, have a negative effect on the print register, and thus on the quality of the printed materials of the type in question to be produced, when the relevant sheet was previously pre-printed using at least one other printing method, for example using an offset printing method and/or using a screen printing method. This deformation caused by the steel engraving process is only partially predictable. It depends on a variety of parameters, such as the material of the printing sheet used or the printing pressure in the intaglio printing press or on the printed pattern itself. Attempts are being made to already counteract these negative effects by partially pre-distorting the printed patterns to be printed in the offset printing method in a prepress stage upstream from the production in order to take the anticipated deformation by the steel engraving process into consideration. The results achievable thereby, however, are not always completely satisfactory. The reason is that printing forms used in the steel engraving process, that is, the steel plates, are subject to wear processes, for example in the form of an elongation, which can result in a displacement of a printed pattern, for example toward a margin or an edge of the relevant sheet and/or in a displacement of different printed patterns with respect to one another. Moreover, usually multiple, for example three, steel plates are alternately used in the same production operation carrying out a steel engraving process in an intaglio printing press, which can create an at least slightly different print register as a function of their installation in the particular intaglio printing press.

To produce the printed materials of the type in question, the differing printing methods involved in production are used consecutively, as mentioned, and more particularly either in a production system that comprises a combination of several printing presses, or in respective separate printing presses that are arranged in a spatially separated manner. The resulting print register is thus also decisively dependent on a respective sheet infeed and/or a respective sheet threading unit at the relevant printing press carrying out the respective printing method.

The print register is furthermore also influenced by causes resulting, for example, from the paper manufacture, such as by a deviation from an intended position of the cut of an infeed edge or side edge of the particular sheet. Sheets are generally cut from a material web, preferably from a paper web, with multiple sheets being arranged next to one another in this material web transversely to its longitudinal direction. The print register resulting later when the printing process is being carried out can also be influenced by the earlier position of the particular sheet in the particular material web since a sheet that is cut from the center of the web behaves differently in the downstream printing process than a sheet that was previously situated at one of the web margins. Additionally, the respective printing substrate moisture level also affects the print register, especially in the case of sheets made of paper.

Due to the aforementioned influencing factors, the need arises, during the make ready of the production system or printing presses, and in particular also during production printing, that is, during ongoing production for producing of the printed materials of the type in question, to check and/or property set up and/or correct the print register, by evaluating a printed pattern in relation to a sheet edge and/or one printed pattern in relation to another printed pattern and/or a printed pattern in relation to a security feature.

In general, the respective designs of banknotes are configured such that a certain variance in the process chain does not pose a problem. For example, allowed tolerances between the individual printing methods involved in the production of the printed materials of the type in question far exceed the degree of tolerances that, for example, the four printing colors of the CMYK offset printing method have with respect to one another. In an offset printing method, in general only a few hundredths of a millimeter are tolerable for the color register, while several tenths of a millimeter are not a problem between the individual printing methods involved in the production of the printed materials of the type in question.

SUMMARY

It is an object herein to provide a method for checking the quality of printed materials, wherein these printed materials are produced consecutively in a particular production operation by means of multiple printing presses.

This object may be achieved in some examples by a method for checking the quality of printed products that are consecutively produced by multiple printing presses to have at least three printed patterns spaced apart from one another. The printed patterns are printed using different printing processes, such as a steel engraving process, an offset printing process, and a screen printing process that may be used for printing the three printed patterns of each printed product. A screen printing press is used for the screen printing process, with multiple steel plates being alternately used in the same production operation for the steel engraving process in an intaglio printing press. For at least two of the steel plates involved in carrying out the steel engraving process, a processing unit may selectively ascertain the deviation of the respective value of the relevant distances associated with the printed patterns, which may be instantaneously ascertained from a defined scale. The dependent claims relate to advantageous embodiments and/or refinements of the identified solution.

The advantages achieved with the invention are, in particular, that the meaningfulness of an ascertained print register is improved, so as to recognize a trend in the print register that are arises, in particular, during production printing, when producing the printed materials of the type in question, and so as to be able to track longer-term drift effects of the print register and be able to then counteract them.

BRIEF DESCRIPTION OF THE DRAWINGS

An exemplary embodiment of the invention is illustrated in the drawings and will be described in greater detail below. The drawings show.

DETAILED DESCRIPTION

Figure 1:
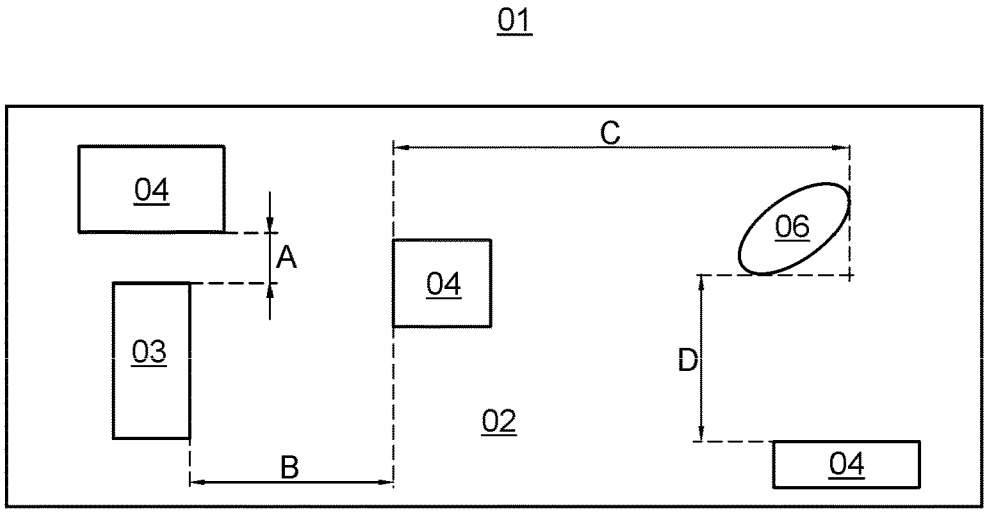
FIG. 1 a banknote including multiple printed patterns spaced apart from one another.

FIG. 1, by way of example and only schematically, shows a printed material 01 in the form of a security document 01, in particular a banknote 01, including printed patterns 03; 04; 06 that are spaced apart from one another, wherein these printed patterns 03; 04; 06 have each been consecutively printed in differing printing processes. In this example, it shall be assumed, without being limited thereto, that the printed pattern denoted by reference numeral 03 has been printed in an offset printing process, and the multiple, for example three, printed patterns each denoted by reference numeral 04 have each been printed in a steel engraving process, and the printed pattern denoted by reference numeral 06 has been printed in a screen printing process, on a preferably rectangular, in particular planar, area 02 to be printed of the printing substrate, which is used to produce the printed material 01 and preferably configured as a sheet. In the design of this printed material 01, reference lines indicated with dotted lines in FIG. 1 were defined, which show the distances A; B; C; D, defined before the start of production, between the printed patterns 03; 04; 06 to be printed or printed in the differing printing processes. A respective scale and a respective associated respectively permissible tolerance are assigned to these distances A; B; C; D. These scales, which each define a target value for each of the distances A; B; C; D, and their respective permissible tolerances are stored in a preferably digital processing unit, wherein this processing unit is configured, for example, as part of a, for example, opto-electronic inspection system, that is, comprising a camera. The quality of printed materials 01 is checked, for example, by evaluating the camera images photographically recording the printed patterns 03; 04; 06 printed onto the printing substrate, wherein these camera images are created by a camera of the inspection system, which is preferably configured as a semiconductor camera.

A method for checking the quality of printed materials 01 is now proposed, which are consecutively produced in a particular production operation by means of multiple printing presses, wherein, for each of these printed materials 01, in each case at least three printed patterns 03; 04; 06, which are each printed in printing methods that differ from one another, are in each case arranged on a respective area 02 to be printed of a printing substrate so as to be spaced apart from one another at the relevant distance A; B; C; D defined for this printed material 01. The inspection system in each case selects two printed patterns 03; 04; 06 printed in differing printing processes for forming a printed pattern pair, wherein, for example the inspection system, that is, preferably a program running in an in particular digital processing unit of this inspection system, in each case assigns a scale that is defined for the respective distance A; B; C; D of the selected printed patterns to the respective printed pattern pair. The respective scale is provided with a tolerance in the inspection system by its processing unit before the particular production operation starts. The respective tolerance is, or is being, defined in each case as a function of the printing methods used in the relevant printed pattern pair.

The respective permissible tolerances may range between 0.3 mm and 3 mm, for example.

The quality of the produced printed materials 01 is now checked in that, during the particular production operation, preferably inline, that is, during ongoing production, a value for the respective distance A; B; C; D between the printed patterns 03; 04; 06 selected for this printed pattern pair is ascertained, preferably by way of programming, by means of the processing unit of the inspection system, at least in a subset from the quantity of all printed materials 01 that have been consecutively produced in the particular production process, with the printed pattern pair of these printed materials 01 being the same in each case. The processing unit then compares the instantaneously ascertained value of the relevant distance A; B; C; D to the scale defined for this distance A; B; C; D, taking into consideration the associated tolerance, and ascertains a deviation of the instantaneously ascertained value of the relevant distance A; B; C; D from its defined scale, taking into consideration the associated tolerance. In the event that the processing unit ascertains an intolerable deviation of the instantaneously ascertained value of the relevant distance A; B; C; D from its defined scale, the relevant printed material 01 is, for example, discharged from the ongoing production process and/or the processing unit, preferably automatically, changes a setting of the relevant printing press which influences the ongoing production process, or at least prompts such a change, so that printed materials 01 produced thereafter by this printing press in each case correspond to the desired quality again.

It may be provided that the inspection system each case forms multiple printed pattern pairs for each printed material 01 whose quality is to be checked, wherein the respective scale of at least two of these printed pattern pairs is provided with a respective tolerance by the inspection system prior to the start of the particular production operation, the tolerances of printed pattern pairs that differ in at least one printing method in each case being differently defined, and the processing unit of the inspection system in each case ascertaining a deviation of the respective value of the relevant distances A; B; C; D, which is instantaneously ascertained in each case, from the respective scale, which is defined in each case, in the formed printed pattern pairs.

As mentioned, a steel engraving method and an offset printing method and a screen printing method are used as printing methods for printing the printed patterns 03; 04; 06 involved in the production of each printed material 01, an intaglio printing press being used for carrying out the steel engraving process, and an offset printing press being used for carrying out the offset printing method, and a screen printing press being used for carrying out the screen printing method. The printed materials 01 can be produced in a single pass in a production system that comprises a combination of multiple printing presses arranged contiguously, or by means of respective separate printing presses that are arranged in a spatially separated manner in consecutive production steps.

In a preferred embodiment of the invention, in the relevant subset, which consists of multiple, for example 50 to 200 printed materials 01, taken from the quantity of all printed materials 01 that have been consecutively produced in the particular production process, the respective instantaneous value for the respective distance A; B; C; D between the respective printed patterns 03; 04; 06 of several of these printed materials 01 belonging to this subset is ascertained by the processing unit of the inspection system, with the at least one printed pattern pair being the same in each case, wherein the processing unit ascertains a mean value from these instantaneously ascertained values for the distances A; B; C; D, and wherein the processing unit ascertains a deviation of the ascertained mean value from its scale defined for this distance A; B; C; D, taking into consideration the associated tolerance.

In a particularly preferred embodiment of the invention, in the case of multiple subsets that are in each case taken from the quantity of all printed materials 01 that have been consecutively produced in the particular production process, a respective instantaneous value for the respective distance A; B; C; D between the respective printed patterns 03; 04; 06 of the printed materials 01 contained in the respective subsets is ascertained by the processing unit of the inspection system, with at least one respective printed image pair being the same in each case, wherein the processing unit ascertains a first mean value from these instantaneously ascertained values for the distances A; B; C; D for each subset, wherein the processing unit ascertains a second mean value from these first mean values, and wherein the processing unit ascertains a deviation of the ascertained second mean value from its scale defined for this distance A; B; C; D, taking into consideration the associated tolerance.

In the two aforementioned embodiments of the invention, the processing unit, in each case before the respective mean value is determined, advantageously checks an instantaneously ascertained value of the relevant distance A; B; C; D for its plausibility and excludes the value from the mean value determination if a lack of plausibility is present. As an alternative or in addition, likewise prior to the determination of the respective mean value, the processing unit can eliminate instantaneously ascertained extreme values, that is, at least one instantaneously ascertained minimum value and/or at least one instantaneously ascertained maximum value, in the respective subset for the respective distance A; B; C; D between the respective printed patterns 03; 04; 06. Moreover, the processing unit can also calculate a standard deviation from the respective mean value in each case.

Printed materials 01 embodied in each case as security documents 01 or as banknotes 01 are frequently produced on a sheet in multiple-ups, so that the relevant printed materials 01 are each arranged in multiple rows and columns on the relevant sheet. The above-described averaging methods are preferably applied to those printed materials 01 that are in each case arranged at the corners of the relevant sheet since, in these positions, the largest deviations of the instantaneously ascertained value of the relevant distance A; B; C; D from the defined scale is to be expected, taking into consideration the associated tolerance. The reason is that the aforementioned disturbing influences become the most noticeable there. The processing unit can also in each case, in particular, calculate an elongation of the at least one printing forme used in a printing method, in particular an elongation of the steel plate carrying out the steel engraving method, from the deviations of printed materials 01 that are in each case arranged at the corner positions of a sheet.

In another important embodiment of the invention, multiple, for example three, steel plates are alternately used in the same production operation for carrying out the steel engraving process in the intaglio printing press, wherein the processing unit, for at least two of the steel plates involved in carrying out the steel engraving process or for all steel plates involved in carrying out the steel engraving process, in each case selectively ascertains the deviation of the respective value of the relevant distances A; B; C; D, which is instantaneously ascertained in each case, from its defined scale, or the deviation of the ascertained mean value from its scale defined for this distance A; B; C; D, or the deviation of the ascertained second mean value from its scale defined for this distance A; B; C; D. The processing unit thus in each case ascertains the respective deviation and/or the respective first and/or second mean values separately for each relevant steel plate.

The ascertained deviation of the respective value of the relevant distances A; B; C; D, which is instantaneously ascertained in each case, from its defined scale and/or the ascertained deviation of the ascertained mean value from its scale defined for this distance A; B; C; D and/or the ascertained deviation of the ascertained second mean value from its scale defined for this distance A; B; C; D, are preferably displayed in each case on a monitor 07 of a display device in a manner that is controlled, for example, by the processing unit of the inspection system.

Figure 2:
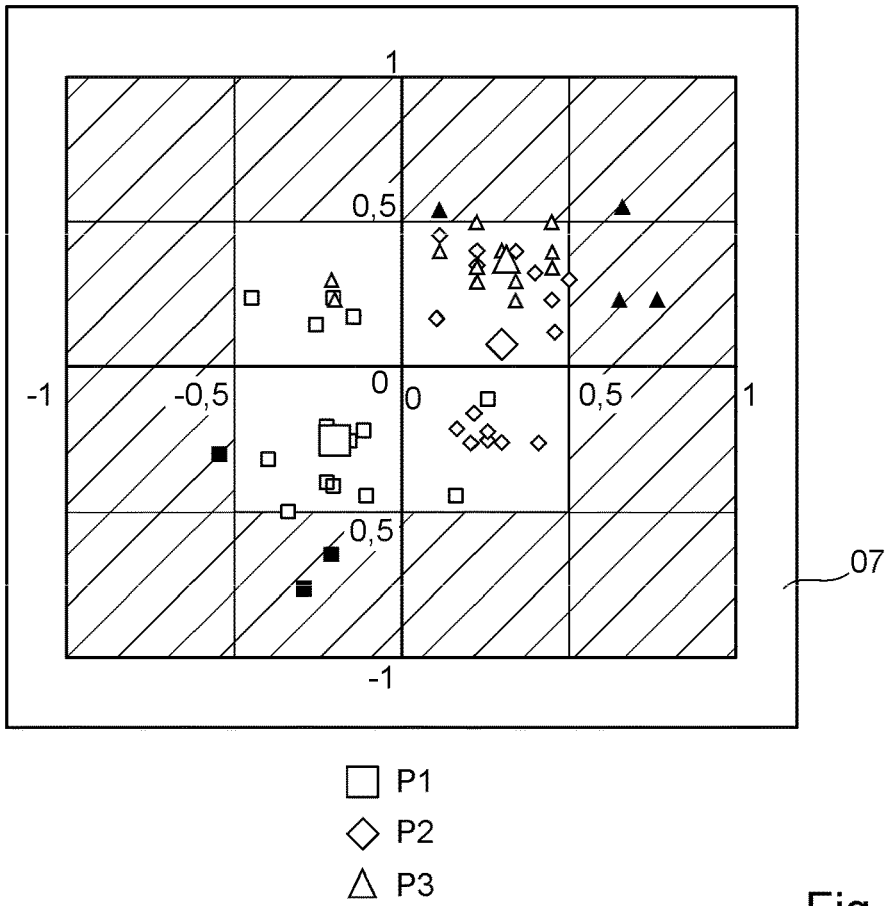
FIG. 2 a representation of results obtained according to the invention on a monitor of a display device.

FIG. 2, by way of example, shows a representation of results obtained according to the invention on the monitor 07 of the display device. A Cartesian coordinate system is shown, for example, on the monitor 07, in which, in each case with reference to the origin of this coordinate system, the respective deviations, as ascertained by the processing unit, of the respective values of at least one of the relevant distances A; B; C; D, which are instantaneously ascertained in each case, from the associated defined scale and/or the ascertained deviations of the ascertained mean value from its scale defined for this distance A; B; C; D and/or the ascertained deviation of the ascertained second mean value from its scale defined for this distance A; B; C; D, are in particular graphically represented.

Specifically, FIG. 2 shows, by way of example, the respective deviations, as ascertained by the processing unit, of the respective values of three distances A; B; C, which are instantaneously ascertained in each case, between a printed pattern 03 printed in each case in an offset printing process, and a printed pattern 04 printed in each case in a steel engraving process, from the respective associated defined scale. These three distances A; B; C; D result, for example, from the use of three steel plates P1; P2; P3 used alternately in the same production operation, for example around the circumference of the same impression cylinder. As mentioned above, printed materials 01 of the type in question are frequently produced on a sheet in multiple-ups. The illustration of FIG. 2 relates, for example, to a printed material 01 that is arranged on the relevant sheet in a corner position. In the illustration of FIG. 2, values generated by the first steel plate P1 are in each case represented, for example, by a square, values generated by the second steel plate P2 are in each case represented, for example, by a diamond, and values generated by the third steel plate P3 are in each case represented, for example, by a triangle. In the immediate surroundings around the origin of the coordinate system, the respective permissible tolerance for the relevant scale is represented. This illustration characterizes a tolerance range that, in this example, extends in each case, both on the x-axis and on the y-axis of the represented coordinate system, from the coordinate value −0.5 to the coordinate value +0.5, whereby a permissible tolerance of ±0.5 mm is indicated for the particular scale. Values and/or deviations to be represented outside this tolerance range and ascertained by the processing unit are represented in different colors, for example, than values to be represented within the respective permissible tolerance range. This illustration in particular allows a trend in the print register that arises during production printing to be easily recognized during the production of the printed materials 01 of the type in question. Moreover, it is possible for the processing unit to calculate further parameters, for example, a change in length of the printing forms, in particular of the steel plates P1; P2; P3, from the ascertained and/or displayed values and/or deviations, possibly taking further information into consideration, for example regarding the position of a particular printed materials 01 in the multiple-ups.

Although the disclosure herein has been described in language specific to examples of structural features and/or methodological acts, it is to be understood that the subject matter defined in the appended claims is not necessarily limited to the specific features or acts described in the examples. Rather, the specific features and acts are disclosed merely as example forms of implementing the claims.

The invention claimed is:

1. A method for checking the quality of printed materials, which are consecutively produced in a particular production operation by means of multiple printing presses, in each case at least three printed patterns being arranged on a respective area to be printed of each of these printed materials so as to be spaced apart from one another at a distance defined for this printed material; these at least three printed patterns being each printed in printing methods that differ from one another; for checking the quality of the respective printed material, two printed patterns printed in differing printing methods being selected by an inspection system for forming a printed pattern pair; the printed pattern pair being assigned a scale that is defined for the distance of its printed patterns; prior to the start of the particular production operation, this scale being provided with a tolerance that is defined as a function of the printing methods used in the relevant printed pattern pair; at least in a subset taken from the quantity of all printed materials that have been consecutively produced in the particular production operation, the quality of the produced printed materials being checked in that, during the particular printing operation, in each case an instantaneous value for the respective distance between the printed patterns selected for this printed pattern pair being ascertained by means of a processing unit of the inspection system, with the printed pattern pair being the same in each case; the processing unit comparing the respective value of the relevant distances, which is instantaneously ascertained in each case, to the scale defined for this distance, taking into consideration the associated tolerance, and ascertaining a deviation of the respective value of the relevant distances, which is instantaneously ascertained in each case, from its defined scale, taking into consideration the associated tolerance; a steel engraving method and an offset printing method being used as printing methods for printing the printed patterns involved in the production of each printed material; an intaglio printing press being used for carrying out the steel engraving method, and an offset printing press being used for carrying out the offset printing method, characterized in that, additionally, a screen printing method is used as a printing method for printing the printed patterns involved in the production of each printed material; a screen printing press being used for carrying out the screen printing process; multiple steel plates being alternately used in the same production operation for carrying out the steel engraving process in the intaglio printing press; and for at least two of the steel plates involved in carrying out the steel engraving process or for all steel plates involved in carrying out the steel engraving process, the processing unit in each case selectively ascertaining the deviation of the respective value of the relevant distances, which is instantaneously ascertained in each case, from its defined scale.

2. The method according to claim 1, characterized in that the printed materials are produced in a production system that comprises a combination of multiple printing presses in a single pass through this production system, or by means of respective separate printing presses that are arranged in a spatially separated manner in consecutive production steps.

3. The method according to claim 1, characterized in that the inspection system each case forms multiple printed pattern pairs for each printed material whose quality is to be checked, the respective distance scale of at least two of these printed pattern pairs being provided with a respective tolerance prior to the start of the particular production operation; the tolerances of printed pattern pairs that differ in at least one printing method in each case being differently defined; and the processing unit of the inspection system in each case ascertaining a deviation of the respective value of the relevant distances, which is instantaneously ascertained in each case, from the respective scale, which is defined in each case, in the formed printed pattern pairs.

4. The method according to claim 1, characterized in that, in the relevant subset from the quantity of all printed materials that have been consecutively produced in the particular production operation, in each case an instantaneous value for the respective distance between the respective printed patterns of several of the printed materials belonging to this subset is ascertained by the processing unit of the inspection system, with the at least one printed pattern pair being the same in each case; the processing unit ascertaining a mean value from these instantaneously ascertained values for the respective distances and the processing unit ascertaining a deviation of the ascertained mean value from its scale defined for this distance, taking into consideration the associated tolerance.

5. The method according to claim 1, characterized in that, in the case of multiple subsets that are taken in each case from the quantity of all printed materials that have been consecutively produced in the particular production operation, a respective instantaneous value for the respective distance between the respective printed patterns of the printed materials contained in the respective subsets is ascertained by the processing unit of the inspection system, with at least one respective printed image pair being the same in each case; the processing unit in each case ascertaining a first mean value from these instantaneously ascertained values for the distances for each subset; the processing unit ascertaining a second mean value from these first mean values; and the processing unit ascertaining a deviation of the ascertained second mean value from its scale defined for this distance, taking into consideration the associated tolerance.

6. The method according to claim 4, characterized in that, prior to the determination of the mean value, the processing unit eliminates instantaneously ascertained extreme values in the respective subset for the respective distance between the respective printed patterns.

7. The method according to claim 4, characterized in that for at least two of the steel plates involved in carrying out the steel engraving process or for all steel plates involved in carrying out the steel engraving process, the processing unit in each case selectively ascertains the deviation of the ascertained mean value from its scale defined for this distance or the deviation of the ascertained second mean value from its scale defined for this distance.

8. The method according to claim 1, characterized in that the ascertained deviation of the respective value of the relevant distances, which is instantaneously ascertained in each case, from its defined scale or the ascertained deviation of the ascertained mean value from its scale defined for this distance or the ascertained deviation of the ascertained second mean value from its scale defined for this distance is in each case represented on the display device.

9. The method according to claim 8, characterized in that a coordinate system is represented on the display device, in which, in each case with reference to the origin of this coordinate system, the respective deviations, as ascertained by the processing unit, of the respective values of at least one of the relevant distances, which are instantaneously ascertained in each case, from the associated defined scale and/or the ascertained deviations of the ascertained mean value from its scale defined for this distance and/or the ascertained deviation of the ascertained second mean value from its scale defined for this distance, are represented.

10. The method according to claim 9, characterized in that the respective permissible tolerances are represented around the origin of the coordinate system and characterize a tolerance range.

11. The method according to claim 10, characterized in that values to be represented outside the tolerance range situated around the origin of the coordinate system are represented in different colors than values to be represented within the respective permissible tolerance range.

* * * * *